United States Patent [19]

De La Cerda

[11] Patent Number: 4,770,192

[45] Date of Patent: Sep. 13, 1988

[54] SEGMENTED CIGARETTE

[76] Inventor: Alberto De La Cerda, 1300 S.W. 122 Ave., #410, Miami, Fla. 33189

[21] Appl. No.: 28,915

[22] Filed: Mar. 23, 1987

[51] Int. Cl.[4] ..... A24D 1/02

[52] U.S. Cl. ..... 131/336; 131/360; 131/365; 131/364

[58] Field of Search ..... 131/336, 360, 365, 364

[56] References Cited

U.S. PATENT DOCUMENTS

| | | | |
|---|---|---|---|
| 1,718,122 | 6/1929 | De Shou | 131/336 |
| 3,902,504 | 9/1975 | Owens, Jr. et al. | 131/360 |
| 3,910,287 | 10/1975 | Walton | 131/360 |

*Primary Examiner*—V. Millin

*Attorney, Agent, or Firm*—John Cyril Malloy

[57] ABSTRACT

The segmented cigarette includes combustible inside and outside tubular walls that are spaced from each other by ridges extending therebetween. The inside wall holds a plurality of elongated segments of tobacco aligned end to end. Different tobaccos may be utilized in each segment. The upstream, axial end of each segment is sealed by paper. The inside wall includes a plurality of gas passages therethrough near the axial end seal such that gas from the burning end of the cigarette passes through those passages into the interspace between the outside and inside walls, expands and cools. This cooling and expansion reduces the accumulation of noxious substances in the segments of tobacco downstream.

4 Claims, 1 Drawing Sheet

SEGMENTED CIGARETTE

BACKGROUND OF THE INVENTION

The present invention relates to a cigarette and particularly relates to a segmented cigarette.

It is commonly recognized that the smoke inhaled from a cigarette includes numerous noxious particulate and gasious substances. It is also recognized that the cigarette smoke, when it cools, expands due to the temperature gradient between the hot smoke and the interior of the lungs of the person smoking. Some of the substances in the smoke may be gaseous at the higher temperature of the hot smoke but be particulate at a lower lung temperature.

OBJECTS OF THE INVENTION

It is an object of the present invention to provide a segmented cigarette wherein different tobaccos are present in segments in the cigarette.

It is another object of the present invention to avoid the accumulation of tars, nicotines, and other noxious particulate material in the tobacco downstream of the lighted end of a cigarette.

It is a further object of the present invention to partially cool the smoke before the smoke is inhaled.

It is another object of the present invention to allow the deposition of certain substances which may be gaseous at a higher temperature but particulate at a lower temperature in portions of the cigarette downstream of the lighted end prior to inhalation of the smoke by the person smoking.

SUMMARY OF THE INVENTION

The segmented cigarette includes combustible inside and outside tubular walls that are spaced from each other by ridges. The inside wall holds a plurality of elongated segments of tobacco aligned end to end. Each tobacco segment includes an axial end paper seal at its upstream end. The inside wall of each segment includes a plurality of gas passages therethrough adjacent the end seal such that gas from the burning end of the cigarette passes through those passages into the interspace between the outside and inside walls, expands and cools as it travels the axial length of the cigarette. This reduces the accumulation of noxious substances in the tobacco segments downstream of the lighted segment.

BRIEF DESCRIPTION OF THE DRAWINGS

Further objects and advantages of the present invention may be found in the description that follows when taken in conjunction with the accompanying drawings in which.

DETAILED DESCRIPTION OF THE PREFERRED EMBODIMENTS

Figure 1:
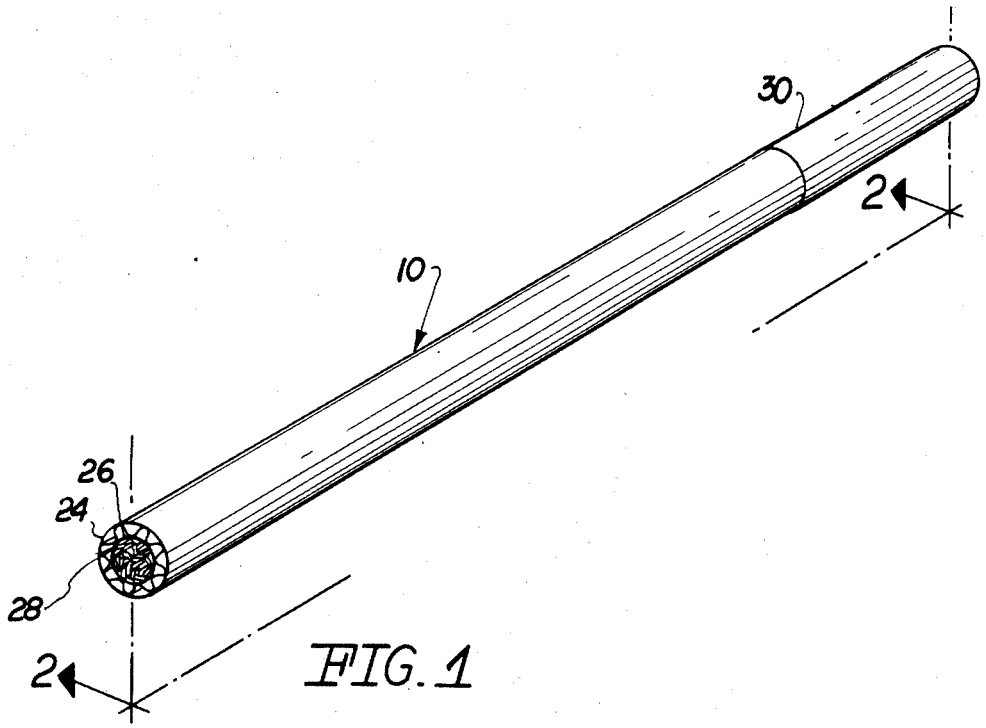
FIG. 1 is a perspective view of the segmented cigarette in accordance with the principles of the present invention.
Figure 2:
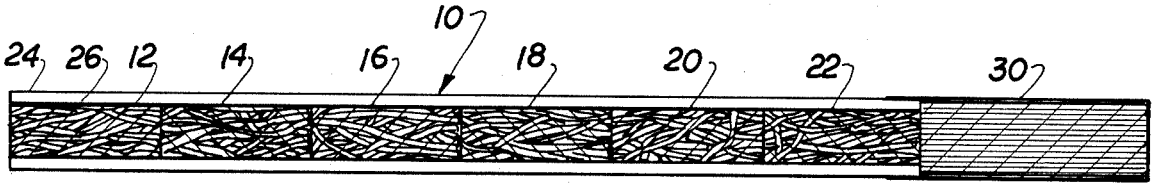
FIG. 2 is the cross-sectional view of the segmented cigarette.
Figure 3:
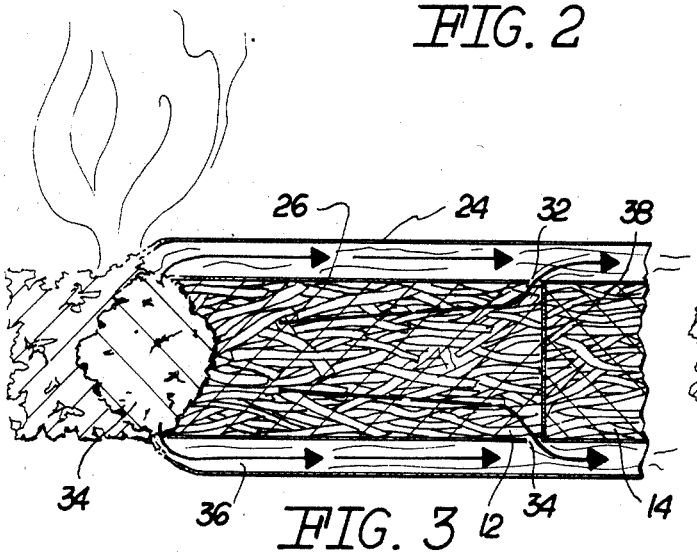
FIG. 3 is a partial, cross-sectional view of a lighted portion of the segmented cigarette; and, FIG. 4 is a further partial, cross-sectional view of the segmented cigarette wherein the end wall of the tobacco segment is consumed by the lighted end of the cigarette.

The present invention relates to a segmented cigarette 10 shown in perspective in FIG. 1. The segmented cigarette includes tobacco segments 12, 14, 16, 18, 20, and 22 shown in the cross-section of the cigarette of FIG. 2. Cigarette 10 includes an outside tubular wall 24 and an inside tubular wall 26. Longitudinally extending ribs 28 span the length of cigarette 10. Ridges 28 may be corrugated in nature or maybe radially extensive as compared with the longitudinal center line of cigarette 10. As can be seen, ribs 28 define longitudinally extending passages in cigarette 10 which extend from one end of the cigarette to a filter 30. As best shown in FIG. 3, inside wall 26 includes gas passages 32 and 34 which allow the cigarette smoke and gas to escape from the interior of tobacco segment 12. Also, smoke from lighted end portion 34 travels in interspace 36 defined between outside wall 24 and inside wall 26.

In one embodiment, each tobacco segment includes a combustible, axial end wall 38 at the upstream end of tobacco segment 14 shown in FIG. 3. Gas passages 32 and 34 are immediately upstream of end wall 38 such that gas escapes through those passages and does not enter downstream tobacco segment 14. The presence of end wall 38 prevents the accumulation of noxious substances in the tobacco segments downstream of lighted segment 12 (for example accumulation of tars and nicotines in segments 14, 16, 18, 20, and 22). Further, gas passing in interspace 36 is cooled and hence substances which are gaseous at a high temperature but particulate at a lower temperature are deposited either in the walls of the cigarette or in filter 30. Also, the gas passing through the interspace is cooled and hence the smoker experiences less discomfort by the expansion of the gas in his lungs.

Figure 4:
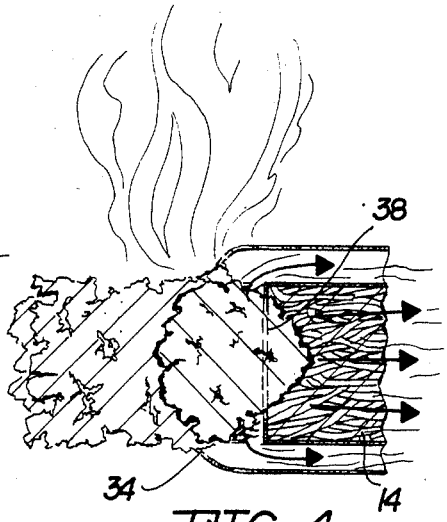

FIG. 4 shows end wall 38 partially consumed by lighted portion 34 thereby lighting tobacco segment 14.

Tobacco segments, 12, 14, 16, 18, and 22 may be different types of tobacco. For example, segment 18 may be mentholated tobacco and segment 22 may be tobacco which is particularly low in tars and nicotines. The claims appended hereto are meant to cover modifications and changes within the scope and spirit of the present invention.

What I claim is:

1. A segmented cigarette comprising:

elongated, combustible, inside and outside tubular walls spaced from each other, said inside walls having a plurality of gas passages therethrough, a plurality of elongated segments of tobacco aligned end-to-end and retained within said inside wall;

combustible spacing means interposed between said inside and outside walls;

each of said segment of tobacco having one axial upstream end thereof sealed with a combustible end wall and said gas passages are immediately upstream of the sealed end walls of said plurality of segments.

2. A cigarette as claimed in claim 1 wherein different tobacco is present in different segments of the cigarette.

3. A cigarette as claimed in claim 1 wherein said spacing means defines longitudinally extending passages through said cigarette.

4. A cigarette as claimed in claim 1 including a filter attached to one end thereof.

* * * * *